US009839078B2

(12) United States Patent
Shiau

(10) Patent No.: US 9,839,078 B2
(45) Date of Patent: Dec. 5, 2017

(54) DRIVING CIRCUIT FOR A LIGHT EMITTING COMPONENT INCLUDING A CONTROL CIRCUIT AND A BOOST CONVERTER CIRCUIT

(71) Applicant: Wen-Chin Shiau, Taoyuan (TW)

(72) Inventor: Wen-Chin Shiau, Taoyuan (TW)

( * ) Notice: Subject to any disclaimer, the term of this patent is extended or adjusted under 35 U.S.C. 154(b) by 0 days.

(21) Appl. No.: 14/689,898

(22) Filed: Apr. 17, 2015

(65) Prior Publication Data

US 2016/0050727 A1 Feb. 18, 2016

(30) Foreign Application Priority Data

Aug. 13, 2014 (TW) ..... 103127784 A

(51) Int. Cl.
*H05B 33/08* (2006.01)
*G05F 1/00* (2006.01)

(52) U.S. Cl.
CPC ..... *H05B 33/0815* (2013.01); *H05B 33/0884* (2013.01); *G05F 1/00* (2013.01)

(58) Field of Classification Search
CPC ..... H05B 33/0815
See application file for complete search history.

(56) References Cited

U.S. PATENT DOCUMENTS 5,982,156 A * 11/1999 Weimer ..... H02M 3/156 307/18
2005/0213353 A1* 9/2005 Lys ..... F21S 48/325 363/17
2006/0233232 A1* 10/2006 He ..... H03K 7/08 375/238
2009/0121801 A1* 5/2009 Cheng ..... H03K 19/00315 332/109
2009/0231052 A1* 9/2009 Li ..... H03K 5/1565 332/109
2009/0322302 A1* 12/2009 Fukushi ..... H02M 1/32 323/284
2010/0220039 A1* 9/2010 Park ..... H02M 3/1588 345/76
2011/0316511 A1* 12/2011 Wang ..... H02M 3/156 323/285
2014/0049730 A1* 2/2014 Lu ..... H05B 33/0815 349/69
2014/0293658 A1* 10/2014 Cao ..... H02M 3/33576 363/21.02
2015/0062483 A1* 3/2015 Zhang ..... H05B 33/0815 349/61
2015/0244353 A1* 8/2015 Humphrey ..... H03K 3/017 327/175

* cited by examiner

*Primary Examiner* — Tung X Le
*Assistant Examiner* — Raymond R Chai
(74) *Attorney, Agent, or Firm* — Muncy, Geissler, Olds & Lowe, P.C.

(57) ABSTRACT

A driving circuit includes a control circuit and a boost converter circuit. The control circuit receives a sense voltage associated with a direct-current (DC) source voltage, and generates a control signal with a duty cycle that varies with the sense voltage in a monotonically increasing manner. The boost converter circuit receives the DC source voltage and the control signal, thereby providing a driving current for driving light emission of a light emitting component. The driving current has a magnitude positively correlated to the duty cycle of the control signal.

1 Claim, 4 Drawing Sheets

DRIVING CIRCUIT FOR A LIGHT EMITTING COMPONENT INCLUDING A CONTROL CIRCUIT AND A BOOST CONVERTER CIRCUIT

CROSS-REFERENCE TO RELATED APPLICATION

This application claims priority of Taiwanese Application No. 103127784, filed on Aug. 13, 2014.

FIELD

The disclosure relates to a driving circuit and a control circuit, and more particularly to a driving circuit and a control circuit for a light emitting component.

BACKGROUND

Conventional LED (light emitting diode) flashlights usually include a DC-DC converter circuit to convert a DC battery voltage from a battery unit into a higher output voltage, and to generate a constant driving current for driving light emission of light emitting diodes. However, over time and with use, internal resistance of the battery unit gradually increases, resulting in gradual decrease of the battery voltage and the output voltage. Under such condition, to maintain the constant driving current may aggravate shortening of battery service life.

SUMMARY

Therefore, an object of the disclosure is to provide a driving circuit for a light emitting component, and a control circuit thereof. The driving circuit may lead to a relatively longer battery life.

According to one aspect of the disclosure, the driving circuit includes a control circuit and a boost converter circuit.

The control circuit is disposed to receive a sense voltage associated with a direct-current (DC) source voltage, and is configured to generate a control signal having a duty cycle that varies with the sense voltage in a monotonically increasing manner.

The boost converter circuit is disposed to receive the DC source voltage and the control signal, and is configured to provide a driving current for driving light emission of a light emitting component. The driving current has a magnitude positively correlated to the duty cycle of the control signal.

According to another aspect of the disclosure, the control circuit is provided for generating a control signal to a boost converter circuit to control light emission of a light emitting component. The boost converter circuit is configured to provide to the light emitting component a driving current with a magnitude associated with a duty cycle of the control signal. The control circuit includes a reference circuit, an oscillator circuit and a pulse width modulation circuit.

The reference circuit is disposed to receive a sense voltage, and is configured to generate a reference voltage having a first preset voltage magnitude when the sense voltage is lower than the first preset voltage magnitude, and having a second preset voltage magnitude higher than the first preset voltage magnitude when the sense voltage is higher than the second preset voltage magnitude.

The oscillator circuit is configured to generate an oscillating signal having a predetermined frequency and a triangular waveform.

The pulse width modulation circuit is configured to receive the reference voltage from the reference circuit and the oscillating signal from the oscillator circuit, to thereby generate the control signal by pulse width modulation. The control signal has a frequency associated with the oscillating signal. The duty cycle of the control signal is associated with the oscillating signal and the reference voltage, and varies with the sense voltage in a monotonically increasing manner.

BRIEF DESCRIPTION OF THE DRAWING

Other features and advantages of the disclosure will become apparent in the following detailed description of the embodiment with reference to the accompanying drawing, of which.

DETAILED DESCRIPTION

Figure 1:
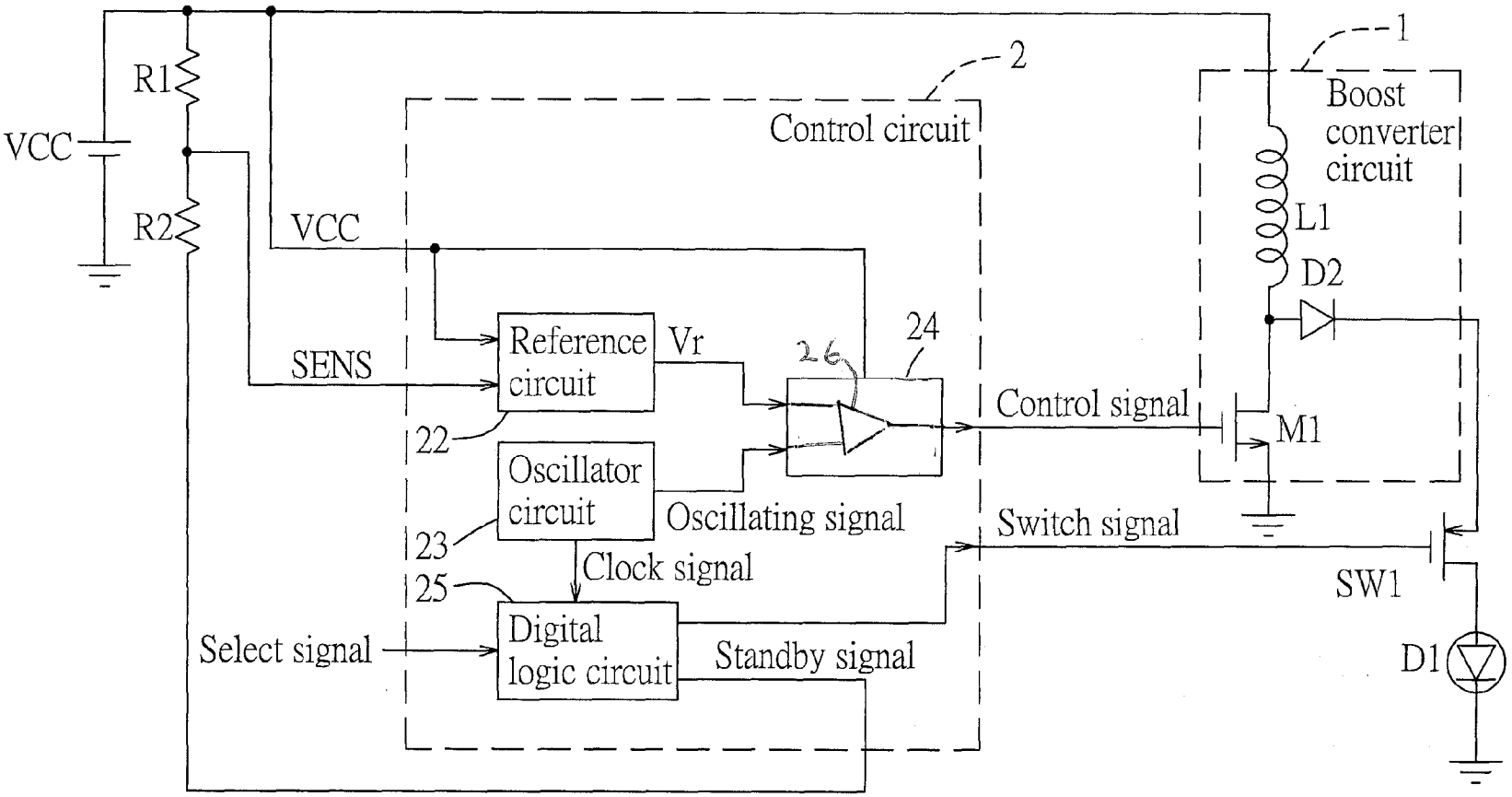
FIG. 1 is a block diagram illustrating an embodiment of the driving circuit according to the disclosure.

Referring to FIG. 1, the embodiment of the driving circuit for driving light emission of a light emitting component (e.g., a light emitting diode (D1) in this embodiment) is shown to include a boost converter circuit 1, a control circuit 2, a current switch (SW1), and two series-connected resistors (R1), (R2).

The boost converter circuit 1 receives a DC (direct-current) source voltage (VCC) and a control signal, and converts the source voltage into a DC output voltage higher than the source voltage (VCC) according to the control signal, thereby providing a driving current for driving light emission of the LED (D1). In this embodiment, the source voltage (VCC) is 3 volts and is provided by two series-connected AA batteries, which are collectively denoted by a single battery symbol. In other embodiments, the source voltage (VCC) may be provided by only one or more than two batteries.

In this embodiment, the boost converter circuit 1 includes a diode (D2), an inductor (L1) and a control switch (M1). The inductor (L1) has a first terminal receiving the source voltage (VCC), and a second terminal coupled to an anode of the diode (D2). The control switch (M1) is configured to make or break electrical connection between a ground node and a common node of inductor (L1) and the diode (D2) (i.e., the anode of the diode (D2)) according to the control signal. By switching operation of the control switch (M1) at a sufficiently high frequency, the output voltage may substantially serve as a DC voltage, and the driving current has a magnitude positively correlated to a duty cycle of the control signal. In this embodiment, the control switch (M1) is an N-type transistor, and may be other types of transistor in other embodiments.

The current switch (SW1) is configured to make or break electrical connection between a cathode of the diode (D2) and an anode of the LED (D1) according to a switch signal. Conduction of the current switch (SW1) allows flow of the driving current to the LED (D1), thereby driving light emission of the LED (D1). In this embodiment, the current switch (SW1) is a P-type transistor, and may be other types of transistor in other embodiments. In some embodiments, the current switch (SW1) may be omitted, and the anode of the LED (D1) may be directly coupled to the cathode of the diode (D2).

In this embodiment, the series-connected resistors (R1), (R2) have a first terminal receiving the source voltage (VCC), a second terminal receiving a first reference voltage, and a common node coupled to the control circuit 2 for providing a sense voltage (SENS) thereto. In this embodiment, the resistor (R1) has a resistance of 100 k ohms, and the resistor (R2) has a resistance of 22 k ohms. In one embodiment, the second terminal may be grounded. Note that the resistance values of each of the resistors (R1), (R2) may be determined according to an internal resistance of the batteries that provide the source voltage (VCC), which may result from different types and/or numbers of batteries, and/or resistance of wires between the batteries and the control circuit 2, and thus may be selected to be different in different embodiments.

Figure 2:
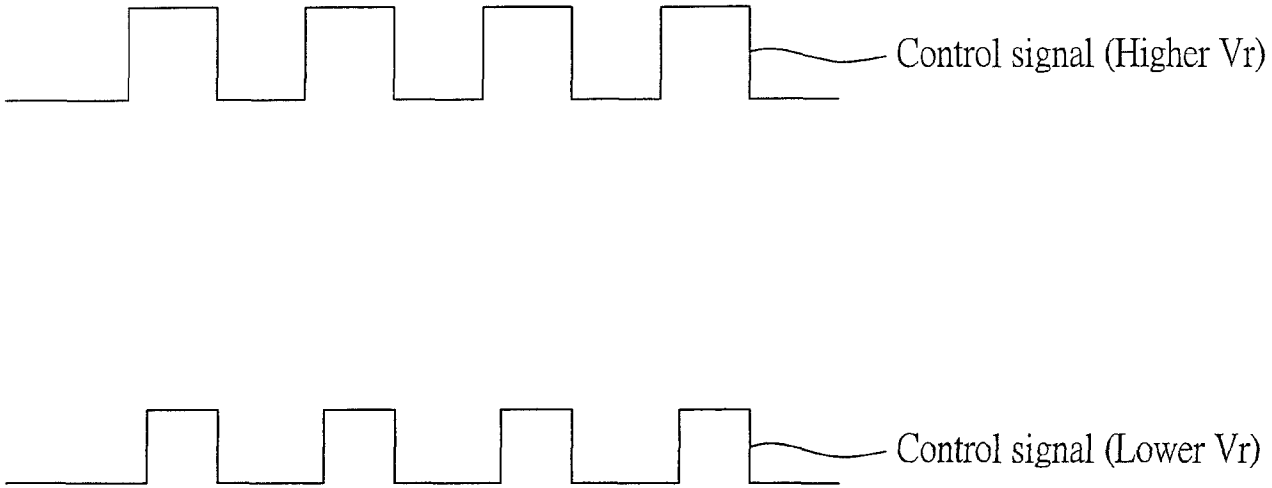
FIG. 2 illustrates that the larger value of Vr results in a larger duty cycle.

In this embodiment, the control circuit 2 includes a reference circuit 22, an oscillator circuit 23, a pulse width modulation (PWM) circuit 24 and a digital logic circuit 25. The control circuit 2 receives the sense voltage (SENS) associated with the source voltage (VCC), and generates the control signal which is provided to the control switch (M1) by pulse width modulation according to the sense voltage (SENS), where the duty cycle of the control signal varies with the sense voltage (SENS) in a monotonically increasing manner as shown in FIG. 2. In one embodiment, a lower sense voltage (SENS) leads to a smaller duty cycle of the control signal, thereby causing the boost converter circuit 1 to output a smaller driving current (i.e., strictly monotonic increasing).

The reference circuit 22 receives the sense voltage (SENS), and generates a DC second reference voltage (Vr) according to the sense voltage (SENS). In practice, the reference circuit 22 is configured such that the second reference voltage (Vr) has a first preset voltage magnitude when the sense voltage (SENS) is lower than the first preset voltage magnitude, and has a second preset voltage magnitude higher than the first preset voltage magnitude when the sense voltage (SENS) is higher than the second preset voltage magnitude.

The oscillator circuit 23 is configured to generate a clock signal, and an oscillating signal having a predetermined constant frequency and a triangular waveform.

Figure 3:
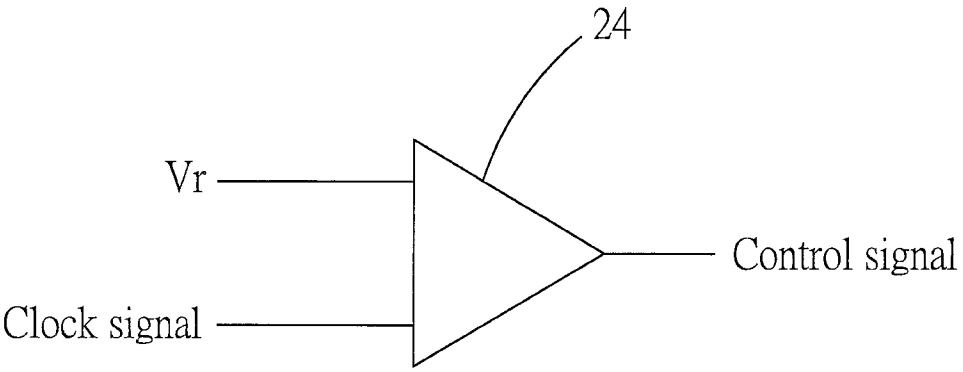
FIG. 3 is a block diagram showing that the PWM circuit includes a comparator.
Figure 4:
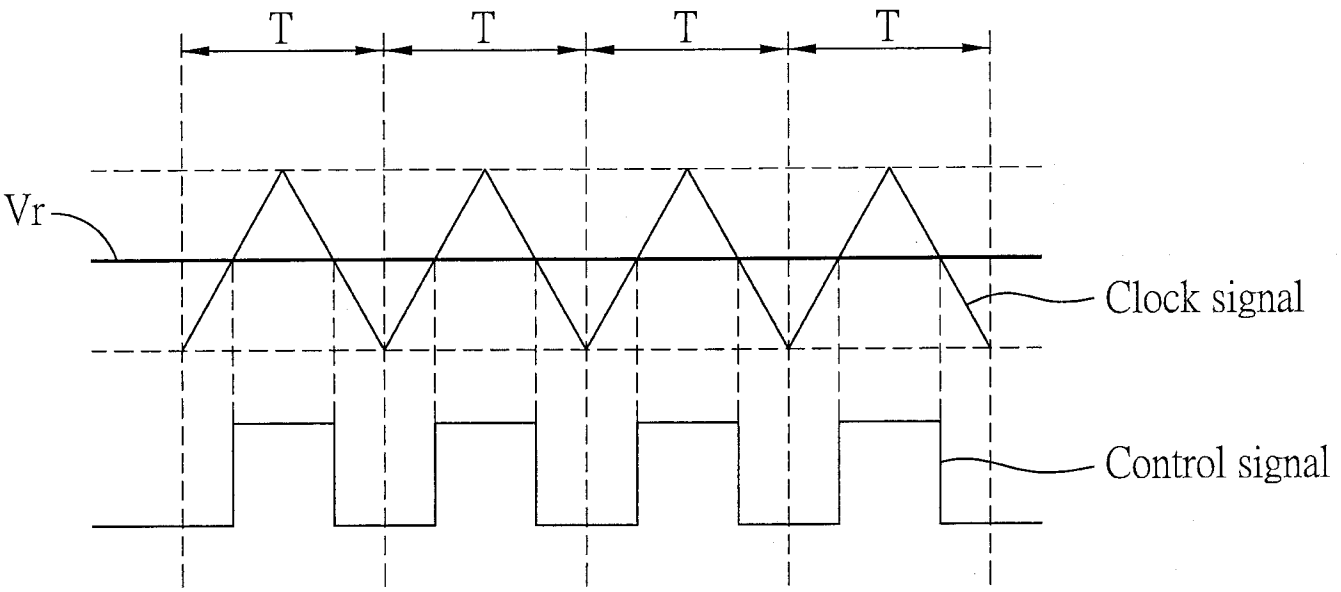
FIG. 4 is a timing diagram showing the relationship between the clock signal and the control signal.

The PWM circuit 24 is electrically connected to the reference circuit 22 and the oscillator circuit 23 to receives the second reference voltage (Vr) and the oscillating signal respectively therefrom, to thereby generate the control signal by pulse width modulation. In practice, as shown in FIG. 3, the PWM circuit 24 may be a comparator 26 that compares the oscillating signal and the second reference voltage (Vr), with the control signal generated by the PWM circuit 24 being logic 0 when a voltage magnitude of the oscillating signal is higher than the second reference voltage (Vr), and being logic 1 when the voltage magnitude of the oscillating signal is lower than the second reference voltage (Vr). (See FIGS. 2 and 4) Accordingly, the control signal has a frequency associated with the oscillating signal, and the duty cycle of the control signal is associated with the oscillating signal and the second reference voltage (Vr).

In this embodiment, the reference circuit 22, the oscillator circuit 23 and the PWM circuit 24 are cooperatively configured such that the control signal satisfies:

$$D = (D\max - D\min) \times \frac{Vin - V1}{V2 - V1} + D\min \text{ when } V2 > Vin > V1$$

$$D = D\max \text{ when } Vin \geq V2$$

$$D = D\min \text{ when } Vin \leq V1$$

where D represents the duty cycle of the control signal, V1 represents the first preset voltage magnitude, V2 represents the second preset voltage magnitude, Dmin is a constant indicating a predetermined minimum duty cycle, Dmax is a constant greater than Dmin and indicating a predetermined maximum duty cycle, and Vin represents an input voltage applied to the reference circuit 22 (the sense voltage (SENS) in this case). In one embodiment, V1=0.2V, V2=1V, Dmax=0.8 and Dmin=0.05.

As mentioned above, the internal resistance of the batteries that generate the source voltage (VCC) may become greater over time and with use, resulting in decrease of the source voltage (VCC) and the sense voltage (SENS). At this time, the second reference voltage (Vr) may decrease with decrease of the sense voltage (SENS), so that the duty cycle of the control signal may gradually reduce. As a result, the output voltage and the driving current of the boost converter circuit 1 may gradually reduce, thereby prolonging lifetime of the batteries that generate the source voltage (VCC).

The digital logic circuit 25 receives the clock signal from the oscillator circuit 23, and an external select signal, and generates a standby signal and the switch signal that is provided to the current switch (SW1) according to the clock signal and the select signal. In this embodiment, the standby signal serves as the first reference voltage provided to the second terminal of the series-connected resistors (R1), (R2). The select signal may specify one of multiple predefined modes of the control circuit 2. In this embodiment, when the select signal specifies an operation mode, the standby signal is logic 0 (e.g., 0V, such that the sense voltage (SENS) has a voltage divided from and proportional to the source voltage (VCC)). When the select signal specifies a standby mode, the standby signal is logic 1 (e.g., a voltage magnitude of the source voltage (VCC)). When the select signal specifies a flash mode, the digital logic circuit 25 may generate the switch signal with a predetermined frequency, thereby controlling the LED (D1) to flash with the predetermined frequency. In some embodiments, the digital logic circuit 25 may be omitted.

In summary, by virtue of the control circuit 2 generating the PWM control signal according to the sense voltage (SENS) associated with the source voltage (VCC), the boost converter circuit 1 may provide a smaller driving current when the source voltage (VCC) becomes lower due to the passage of time and use, thereby prolonging lifetime of the batteries that provide the source voltage (VCC).

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A driving circuit for driving light emission of a light emitting component, comprising:

a control circuit receiving a sense voltage associated with a direct-current (DC) source voltage, and generating a control signal having a duty cycle that varies with the sense voltage in a monotonically increasing manner; and a boost converter circuit receiving the DC source voltage and the control signal, and providing a driving current for driving light emission of the light emitting component, the driving current having a magnitude positively correlated to the duty cycle of the control signal;

wherein said control circuit includes:

a reference circuit receiving the sense voltage, and generating a reference voltage;

an oscillator circuit generating an oscillating signal having a predetermined frequency and a triangular waveform;

a pulse width modulation circuit receiving the reference voltage from said reference circuit and the oscillating signal from said oscillator circuit, to thereby generate the control signal by pulse width modulation, the control signal having a frequency associated with the oscillating signal, the duty cycle of the control signal being associated with the oscillating signal and the reference voltage; and a logic circuit receiving a select signal and a clock signal from the oscillator circuit and generating a standby signal and a switch signal according to the select signal, the switch signal controlling a current switch between the boost converter circuit and the light emitting component.

* * * * *